US012599236B2

(12) United States Patent
Guo

(10) Patent No.: US 12,599,236 B2
(45) Date of Patent: Apr. 14, 2026

(54) BENCH

(71) Applicant: Yonggang Guo, Shenzhen (CN)

(72) Inventor: Yonggang Guo, Shenzhen (CN)

( * ) Notice: Subject to any disclaimer, the term of this patent is extended or adjusted under 35 U.S.C. 154(b) by 190 days.

(21) Appl. No.: 18/424,733

(22) Filed: Jan. 26, 2024

(65) Prior Publication Data

US 2025/0241443 A1 Jul. 31, 2025

(51) Int. Cl.
*A47C 4/02* (2006.01)

(52) U.S. Cl.
CPC ..... *A47C 4/022* (2013.01); *A47C 4/028* (2013.01)

(58) Field of Classification Search
CPC ..... A47C 4/022; A47C 4/028; A47C 9/10; A47C 11/00; A47C 5/043; A47C 9/00; A47C 16/02; A47C 4/03
See application file for complete search history.

(56) References Cited

U.S. PATENT DOCUMENTS 11,103,073 B1 * 8/2021 Hertlein ..... B65D 51/24
11,311,437 B2 4/2022 Baiera
11,737,562 B2 8/2023 Purchas et al.
11,751,727 B1 9/2023 Ndiaye
11,812,869 B2 11/2023 Du
2007/0046077 A1 * 3/2007 Fang ..... A47C 4/03 297/130
2022/0144372 A1 5/2022 Abdelfattah

FOREIGN PATENT DOCUMENTS

KR 200468499 Y1 * 8/2013 ..... A01K 97/22

* cited by examiner

*Primary Examiner* — Timothy D Collins
*Assistant Examiner* — Justin Michael Heston
(74) *Attorney, Agent, or Firm* — Nitin Kaushik

(57) ABSTRACT

Provided in the present invention is a bench, including: a seat plate, a first bracket detachably connected to a first end of the seat plate, a second bracket detachably connected to a second end of the seat plate, at least one first telescopic rod hingedly mounted on the first bracket, and at least one second telescopic rod hingedly mounted on the second bracket. A first mounting arm is mounted on the first bracket, and the first mounting arm is locked with the first end of the seat plate by means of a pin shaft. A second mounting arm is mounted on the second bracket, and the second mounting arm is locked with the second end of the seat plate by means of a pin shaft. The bench has good stability, is convenient to assemble and disassemble, is easy to carry, and is very practical.

14 Claims, 3 Drawing Sheets

BENCH

TECHNICAL FIELD

The present invention relates to the field of furniture technology, in particular to a bench.

BACKGROUND

A bench, also known as a stool, is a type of seat with a wooden surface and without a backrest, often in a narrow and elongated shape. According to the materials, benches can be divided into bamboo stools, wooden stools, stone stools, plastic stools, glass stools, insulated stools, etc. According to the shape, benches can be divided into square stools, round stools, long stools, T-shaped stools, I-shaped stools, folding stools, Z-shaped stools, etc. According to the uses, benches can be divided into horse stools, sketching stools, etc. Conventional benches are mostly assembled by means of a tenon-mortise structure or are fixedly assembled by means of screws, which are difficult to assemble and disassemble, have a large occupied space and are not easy to carry, have poor stability in use, and sometimes tilt.

SUMMARY

On the basis of these, aiming at the problem existing in the existing benches, it is necessary to provide a bench having good stability, being convenient to assemble and disassemble, and being easy to carry.

A bench, including: a seat plate, a first bracket detachably connected to a first end of the seat plate, a second bracket detachably connected to a second end of the seat plate, at least one first telescopic rod hingedly mounted on the first bracket, and at least one second telescopic rod hingedly mounted on the second bracket, where a first mounting arm is mounted on the first bracket, and the first mounting arm is locked with the first end of the seat plate by means of a pin shaft; a second mounting arm is mounted on the second bracket, and the second mounting arm is locked with the second end of the seat plate by means of a pin shaft.

As the first bracket is detachably connected to the first end of the seat plate and the second bracket is detachably connected to the second end of the seat plate, when in use, the bench can be conveniently disassembled and assembled according to needs, thereby being capable of reducing the space occupation according to needs and being easy to carry. Furthermore, a first telescopic rod is hingedly mounted on the first bracket and a second telescopic rod is hingedly mounted on the second bracket. In this way, when in use, two supporting inclined leg structures can be formed by the first telescopic rod and the second telescopic rod, thereby improving the stability of the whole bench, and being not easy to tilt.

In one of the embodiments, a first limiting rod is mounted on the first mounting arm, a first clamping port is provided on the first end of the seat plate, and the first clamping port is clamped with the first limiting rod.

In one of the embodiments, the first limiting rod comprises a first long rod body and two first short rod bodies with one end connected to the first long rod body, two ends of the first long rod body are respectively connected to the first mounting arm, and the other end of each of the first short rod bodies is connected to the first mounting arm.

In one of the embodiments, a second limiting rod is mounted on the second mounting arm, a second clamping port is provided on the second end of the seat plate, and the second clamping port is clamped with the second limiting rod.

In one of the embodiments, the second limiting rod comprises a second long rod body and two second short rod bodies with one end connected to the second long rod body, two ends of the second long rod body are respectively connected to the second mounting arm, and the other end of each of the second short rod bodies is connected to the second mounting arm.

In one of the embodiments, a first accommodating groove is provided on the first bracket, and the first telescopic rod is located in the first accommodating groove.

In one of the embodiments, the first telescopic rod comprises a first outer tube body and a first inner tube body sleeved inside the first outer tube body; a plurality of first adjustment holes are provided on one end of the first outer tube body away from the seat plate; first elastic columns are mounted on the first inner tube body; and the first elastic columns are fitted with the first adjustment holes.

In one of the embodiments, a second accommodating groove is provided on the second bracket, and the second telescopic rod is located in the second accommodating groove.

In one of the embodiments, the second telescopic rod comprises a second outer tube body and a second inner tube body sleeved inside the second outer tube body; a plurality of second adjustment holes are provided on one end of the second outer tube body away from the seat plate; second elastic columns are mounted on the second inner tube body; and the second elastic columns are fitted with the second adjustment holes.

In one of the embodiments, the bench further comprises a seat cushion mounted on the seat plate, and the seat cushion is provided around the seat plate.

BRIEF DESCRIPTION OF DRAWINGS

The accompanying drawings, which form a part of the present application, are used to provide a further understanding of the present invention. The schematic embodiments of the present invention and the description thereof are used to explain the present invention, and do not form improper limits to the present invention. In the drawings.

DETAILED DESCRIPTION OF THE EMBODIMENTS

Figure 1:
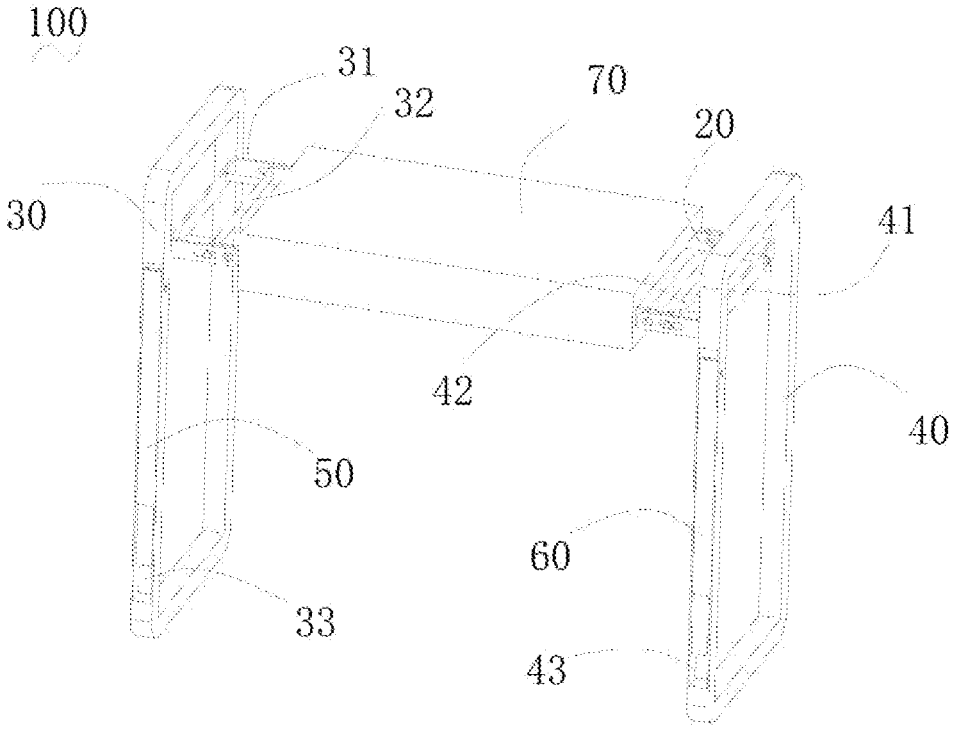
FIG. 1 is a schematic view of a bench according to the present invention.

To facilitate understanding of the present invention, the present invention will be described more comprehensively below with reference to related drawings. Preferred embodiments of the present invention are provided in the drawings. However, the present invention may be achieved in various forms, and is not limited to the embodiments herein. On the contrary, these embodiments are provided for a more thorough and comprehensive understanding of the content disclosed in the present invention.

It should be noted that when an element is expressed as "fixed to" another element, it may be directly located on another element, or there may be an intermediate element. When an element is expressed as "connected to" another element, it may be directly connected to another element, or there may be an intermediate element at the same time. In addition, the term "and/or" herein is only intended to describe association relationships of related objects, and indicates that there may be three relationships, for example, the expression of "A and/or B" may indicate the following three conditions: A exists separately, A and B exist at the same time, and B exists separately.

Unless otherwise defined, all technical and scientific terms used herein have the same meanings as those generally understood by those skilled in the art of the present invention. The terms used in the description of the present invention herein are only for the purpose of describing particular embodiments, for example, "inner", "outer", "left", "right" and similar expressions are only for the purpose of illustration, and are not intended to limit the present invention.

Figure 2:
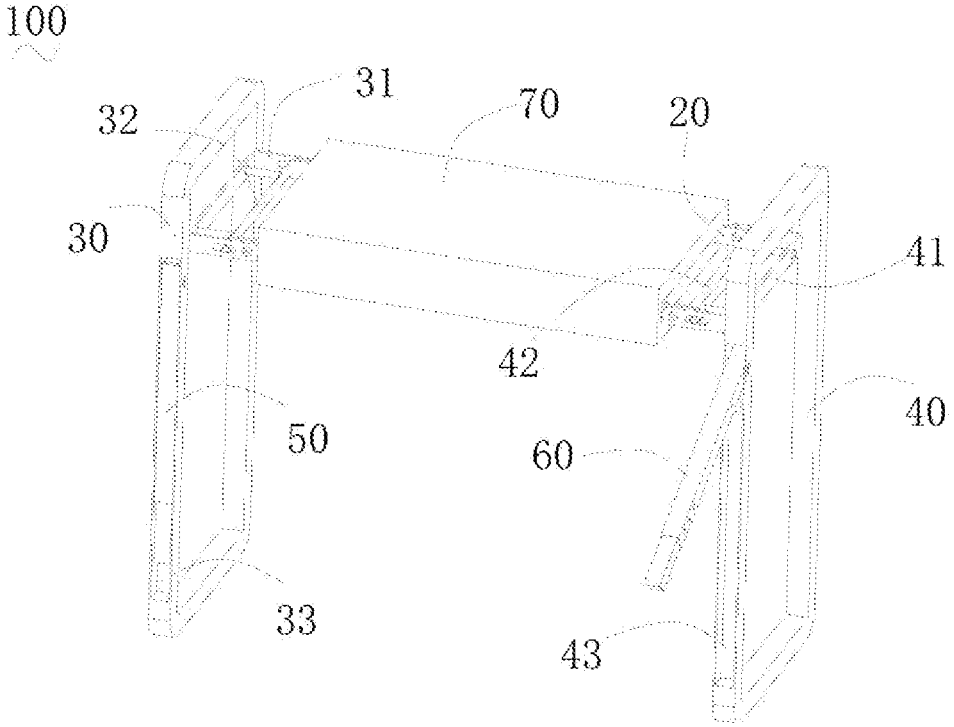
FIG. 2 is a schematic view of another state of the bench as shown in FIG. 1.
Figure 3:
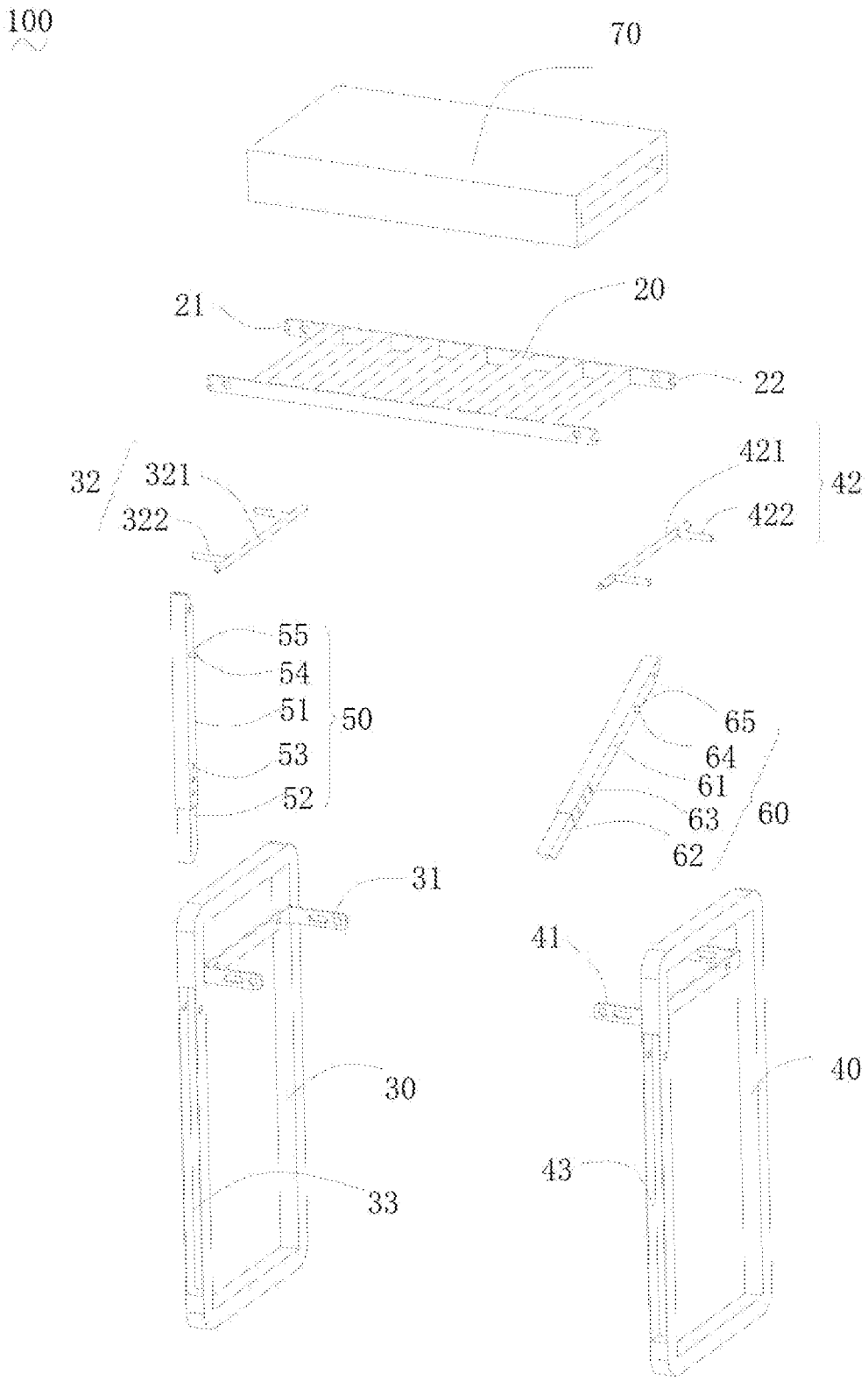
FIG. 3 is an exploded view of the bench as shown in FIG. 2.

FIGS. 1 to 3 are schematic views of a bench 100 according to the present invention. The bench 100 includes: a seat plate 20, a first bracket 30 detachably connected to a first end of the seat plate 20, a second bracket 40 detachably connected to a second end of the seat plate 20, at least one first telescopic rod 50 hingedly mounted on the first bracket 30, and at least one second telescopic rod 60 hingedly mounted on the second bracket 40. A first mounting arm 31 is mounted on the first bracket 30, the first mounting arm 31 is locked with the first end of the seat plate 20 by means of a pin shaft (not shown), a second mounting arm 41 is mounted on the second bracket 40, and the second mounting arm 41 is locked with the second end of the seat plate 20 by means of a pin shaft (not shown). When in use, the mounting and connecting states of the seat plate 20, the first mounting arm 31 and the second mounting arm 41 can be changed by means of the pin shaft, so that the assembly and disassembly are convenient and fast.

In this embodiment, a first telescopic rod 50 is mounted on the first bracket 30, and a second telescopic rod 60 is mounted on the second bracket 40; the first telescopic rod 50 and the second telescopic rod 60 are located on the same side. In this way, two auxiliary supporting points can be formed on the side when in use, so that the bench has enhanced stability and is not easy to tilt during use. In other embodiments, two first telescopic rods 50 are mounted on the first bracket 30, the two first telescopic rods 50 are symmetrically located at two sides of the first bracket 30, two second telescopic rods 60 are mounted on the second bracket 40, and the two second telescopic rods 60 are symmetrically located at two sides of the second bracket 40. In this way, four auxiliary supporting points can be formed on the bench 100 when in use, so that the bench has enhanced stability and is not easy to tilt during use.

Further, a first limiting rod 32 is mounted on the first mounting arm 31, a first clamping port 21 is provided on the first end of the seat plate 20, and the first clamping port 21 is clamped with the first limiting rod 32, so that the clamping stability of the seat plate 20 is further improved. The first limiting rod 32 comprises a first long rod body 321 and two first short rod bodies 322 with one end connected to the first long rod body 321, two ends of the first long rod body 321 are respectively connected to the first mounting arm 31, and the other end of each of the first short rod bodies 322 is connected to the first mounting arm 31.

Further, a second limiting rod 42 is mounted on the second mounting arm 41, a second clamping port 22 is provided on the second end of the seat plate 20, and the second clamping port 22 is clamped with the second limiting rod 42, so that the clamping stability of the seat plate 20 is further improved. The second limiting rod 42 comprises a second long rod body 421 and two second short rod bodies 422 with one end connected to the second long rod body 421, two ends of the second long rod body 421 are respectively connected to the second mounting arm 41, and the other end of each of the second short rod bodies 422 is connected to the second mounting arm 41.

Further, a first accommodating groove 33 is provided on the first bracket 30, and the first telescopic rod 50 is located within the first accommodating groove 33. In this way, the first telescopic rod 50 can be accommodated within the first accommodating groove 33 when the first telescopic rod 50 does not need to be used, so that the whole occupied space is reduced, and the appearance is elegant. In this embodiment, one first accommodating slot 33 is provided and extends along a vertical direction.

Further, a second accommodating groove 43 is provided on the second bracket 40, and the second telescopic rod 60 is located within the second accommodating groove 43. In this way, the second telescopic rod 60 can be accommodated within the second accommodating groove 43 when the second telescopic rod 60 does not need to be used, so that the whole occupied space is reduced, and the appearance is elegant. In this embodiment, one second accommodating slot 43 is provided and extends along a vertical direction.

Further, the first telescopic rod 50 comprises a first outer tube body 51 and a first inner tube body 52 sleeved inside the first outer tube body 51; the first outer tube body 51 is hinged to the first bracket 30, a plurality of first adjustment holes 53 are provided on one end of the first outer tube body 51 away from the seat plate 20; first elastic columns 54 are mounted on the first inner tube body 52; and the first elastic columns 54 are fitted with the first adjustment holes 53, so that the first outer tube body 51 and the first inner tube body 52 can be adjusted to change the length by means of multi-level telescoping. In this embodiment, both the first outer tube 51 and the first inner tube 52 are rectangular tubes, so that the stability is good and the phenomenon of loose rotation is not easy to occur. Still further, first locking holes 55 are provided on one end of the first outer tube body 51 close to the seat plate 20, and the first locking holes 55 are fitted with the first elastic columns 54. When the whole first telescopic rod 50 needs to be placed in the first accommodating groove 33, the first elastic columns 54 extend out of the first locking holes 55 for limiting.

Further, the second telescopic rod 60 comprises a second outer tube body 61 and a second inner tube body 62 sleeved inside the second outer tube body 61; the second outer tube body 61 is hinged to the second bracket 40, a plurality of second adjustment holes 63 are provided on one end of the second outer tube body 61 away from the seat plate 20; second elastic columns 64 are mounted on the second inner tube body 62; and the second elastic columns 64 are adapted to the second adjustment holes 63, so that the second outer tube body 61 and the second inner tube body 62 can be adjusted to change the length by means of multi-level telescoping. In this embodiment, both the second outer tube 61 and the second inner tube 62 are rectangular tubes, so that the stability is good and the phenomenon of loose rotation is not easy to occur. Still further, second locking holes 65 are provided on one end of the second outer tube body 61 close to the seat plate 20, and the second locking holes 65 are fitted with the second elastic columns 64. When the whole second telescopic rod 60 needs to be placed in the second accommodating groove 43, the second elastic columns 64 extend out of the second locking holes 65 for limiting.

Further, the bench 100 further comprises a seat cushion 70 mounted on the seat plate 20, and the seat cushion 70 is provided around the seat plate 20. By providing the seat cushion 70, the seat plate 20 can have the improved supporting flexibility when in use and is comfortable to sit.

As the first bracket 30 is detachably connected to the first end of the seat plate 20 and the second bracket 40 is detachably connected to the second end of the seat plate 20, when in use, the bench 100 can be conveniently disassembled and assembled according to needs, thereby being capable of reducing the space occupation according to needs and being easy to carry. Furthermore, a first telescopic rod 50 is hingedly mounted on the first bracket 30 and a second telescopic rod 60 is hingedly mounted on the second bracket 40. In this way, when in use, two supporting inclined leg structures can be formed by the first telescopic rod 50 and the second telescopic rod 60, thereby increasing the stability of the whole bench 100, and being not easy to tilt.

The technical features of the above embodiments can be combined arbitrarily. In order to simplify the description, possible combinations of the technical features of the above embodiments are not completely described. However, as long as there is no contradiction between the combinations of these technical features, the combinations should be considered to fall within the scope of the present specification.

The above embodiments only express several embodiments of the present invention, and relative specific and detailed descriptions thereof are provided. However, these embodiments cannot be understood as limitations on the scope of the patent of the present invention. It should be pointed out that for those of ordinary skill in the art, several modifications and improvements can be made without departing from the idea of the present invention, and all these modifications and improvements should fall within the scope of protection of the present invention. Therefore, the scope of protection of the patent of the present invention should be subject to the claims.

What is claimed is:

1. A bench, comprising: a seat plate, a first bracket detachably connected to a first end of the seat plate, a second bracket detachably connected to a second end of the seat plate, at least one first telescopic rod hingedly mounted on the first bracket, and at least one second telescopic rod hingedly mounted on the second bracket, wherein a first mounting arm is mounted on the first bracket, and the first mounting arm is locked with the first end of the seat plate by means of a pin shaft; a second mounting arm is mounted on the second bracket, and the second mounting arm is locked with the second end of the seat plate by means of a pin shaft;

wherein a first limiting rod is mounted on the first mounting arm, a first clamping port is provided on the first end of the seat plate, and the first clamping port is clamped with the first limiting rod.

2. The bench according to claim 1, wherein the first limiting rod comprises a first long rod body and two first short rod bodies with one end connected to the first long rod body, two ends of the first long rod body are respectively connected to the first mounting arm, and another end of each of the first short rod bodies is connected to the first mounting arm.

3. The bench according to claim 1, wherein a first accommodating groove is provided on the first bracket, and the first telescopic rod is located in the first accommodating groove.

4. The bench according to claim 1, wherein the first telescopic rod comprises a first outer tube body and a first inner tube body sleeved inside the first outer tube body; a plurality of first adjustment holes are provided on one end of the first outer tube body away from the seat plate; a first elastic column is mounted on the first inner tube body; and the first elastic column is configured to be fitted with each of the first adjustment holes.

5. The bench according to claim 1, wherein a second accommodating groove is provided on the second bracket, and the second telescopic rod is located in the second accommodating groove.

6. The bench according to claim 1, wherein the second telescopic rod comprises a second outer tube body and a second inner tube body sleeved inside the second outer tube body; a plurality of second adjustment holes are provided on one end of the second outer tube body away from the seat plate; a second elastic column is mounted on the second inner tube body; and the second elastic column is configured to be fitted with each of the second adjustment holes.

7. The bench according to claim 1, wherein the bench further comprises a seat cushion mounted on the seat plate, and the seat cushion is provided around the seat plate.

8. A bench, comprising: a seat plate, a first bracket detachably connected to a first end of the seat plate, a second bracket detachably connected to a second end of the seat plate, at least one first telescopic rod hingedly mounted on the first bracket, and at least one second telescopic rod hingedly mounted on the second bracket, wherein a first mounting arm is mounted on the first bracket, and the first mounting arm is locked with the first end of the seat plate by means of a pin shaft; a second mounting arm is mounted on the second bracket, and the second mounting arm is locked with the second end of the seat plate by means of a pin shaft;

wherein a second limiting rod is mounted on the second mounting arm, a second clamping port is provided on the second end of the seat plate, and the second clamping port is clamped with the second limiting rod.

9. The bench according to claim 8, wherein the second limiting rod comprises a second long rod body and two second short rod bodies with one end connected to the second long rod body, two ends of the second long rod body are respectively connected to the second mounting arm, and another end of each of the second short rod bodies is connected to the second mounting arm.

10. The bench according to claim 8, wherein a first accommodating groove is provided on the first bracket, and the first telescopic rod is located in the first accommodating groove.

11. The bench according to claim 8, wherein the first telescopic rod comprises a first outer tube body and a first inner tube body sleeved inside the first outer tube body; a plurality of first adjustment holes are provided on one end of the first outer tube body away from the seat plate; a first elastic column is mounted on the first inner tube body; and the first elastic column is configured to be fitted with each of the first adjustment holes.

12. The bench according to claim 8, wherein a second accommodating groove is provided on the second bracket, and the second telescopic rod is located in the second accommodating groove.

13. The bench according to claim 8, wherein the second telescopic rod comprises a second outer tube body and a second inner tube body sleeved inside the second outer tube body; a plurality of second adjustment holes are provided on one end of the second outer tube body away from the seat plate; a second elastic column is mounted on the second inner tube body; and the second elastic column is configured to be fitted with each of the second adjustment holes.

14. The bench according to claim 8, wherein the bench further comprises a seat cushion mounted on the seat plate, and the seat cushion is provided around the seat plate.

* * * * *